United States Patent [19]

Agrawal

[11] Patent Number: 4,551,175

[45] Date of Patent: Nov. 5, 1985

[54] METHOD FOR CONTROLLING SLAG CHEMISTRY IN A REFINING VESSEL

[75] Inventor: Balkishan Agrawal, Ossining, N.Y.

[73] Assignee: Union Carbide Corporation, Danbury, Conn.

[21] Appl. No.: 601,286

[22] Filed: Apr. 17, 1984

[51] Int. Cl.[4] ..... C21C 7/00

[52] U.S. Cl. ..... 75/513; 75/82; 75/51.6

[58] Field of Search ..... 75/60, 59

[56] References Cited

U.S. PATENT DOCUMENTS 4,286,774 9/1981 Benatar ..... 75/60

*Primary Examiner*—Peter D. Rosenberg

*Attorney, Agent, or Firm*—Eugene Lieberstein

[57] ABSTRACT

Method for slag chemistry control in a refractory lined vessel during the process of refining metal by the injection of oxygen gas during a period of oxidation and by the injection of nonoxidizing gas or gases during a period of reduction and melt specification adjustment such that the slag at the completion of the refining process will have a preselected composition consisting essentially of A% alumina ($Al_2O_3$), B% silica ($SiO_2$), C% CaO and D% MgO and a ratio X of alumina to silica equal to a preselected value of between about 0.1 to 10. The preselected slag chemistry at the completion of refining is achieved by using a combination of aluminum and silicon to achieve as completely as possible the preselected ratio of alumina to silica in the slag while at the same time satisfying the fuel, reduction, and specification silicon requirements of the bath at the given intervals corresponding to the end of the oxidizing period, the reducing period and the final trim.

32 Claims, No Drawings

METHOD FOR CONTROLLING SLAG CHEMISTRY IN A REFINING VESSEL

This invention relates in general to the refining of metal in a refining vessel and more particularly to a method of controlling the slag chemistry of a liquid metal bath within a refining converter vessel during a refining operation.

Molten metal may be transferred to a refining vessel to refine the metal. The molten metal may consist of any steel such as carbon steel, low alloy steel, tool steel and stainless steel or other metals such as nickel based or cobalt based alloys. The refining operation usually involves decarburization of the bath or melt and may also include bath heating, degassing, desulfurization and tramp element removal as well.

In accordance with the present invention, decarburization and bath heating are achieved by the injection of oxygen gas, preferably subsurfacely, alone or in combination with one or more gases selected from the group consisting of argon, nitrogen, ammonia, steam, carbon dioxide, hydrogen, methane or higher hydrocarbon gas. The gases may be introduced by following various conventional blowing programs depending on the grade of steel made and on the specific gases used in combination with oxygen.

A reduction step is also performed, and during at least part of the reduction period nonoxidizing gases are injected into the bath for aiding the equilibration of reactions between the slag and metal.

A process which as received wide acceptance in the steel industry for refining metal is the argon-oxygen decarburization process also referred to as the "AOD" process. The AOD process is disclosed in U.S. Pat. Nos. 3,252,790, 3,046,107, 4,187,102 and 4,278,464 the disclosures of which are incorporated herein by reference. Although the present invention is particularly suited to the AOD process, it is also applicable to other conventional converter operations such as "KVOD", "VODC", "VOD" and "CLU", and would be applicable to "BOF" or "Q-BOP" operation if a reducing step were carried out in the vessel and subsurface gas injection were used for equilibration during reduction. In general, the present invention is applicable to all metal refining operations in which the amount of each oxide generated in the slag can be predicted by mass balance and/or statistical calculations and in which reduction of the slag is carried out in the refining vessel.

The refining process of the present invention includes a period of oxidation during which time decarburization and any bath heating occur and a priod of reduction to reduce the oxidized alloying elements and/or iron from a basic slag. The refining process is completed with a final trim adjustment of the bath composition to meet melt specifications. The reducing period and final trim are generally referred to in the art as the finishing steps of the refining process following oxidation.

The bath is heated or fueled by exothermic oxidation reactions which take place during the oxidation period of the refining process and the bath generally cools during the reducing and trim period. If fuel is needed, aluminum and/or silicon are conveniently used as fuel additives to provide the temperature rise to the bath so that a sufficiently high temperature exists at the start of the reducing period to permit the finishing steps to be carried out.

Upon transfer into the refining vessel, the initial slag includes any transferred slag and/or precharged basic fluxes and is composed of the acidic oxide components $SiO_2$ (silica) and $Al_2O_3$ (alumina) and the basic components CaO and MgO as well as other minor constituents. During the refining process, additional acidic oxide components are formed and become part of the slag when either aluminum or silicon or their compounds such as silicon carbide is oxidized. In the early or oxidizing period of processing a given heat of metal, the acidic components are generated by the oxidation of any silicon contained in the transfer metal and by the oxidation of either aluminum or silicon or a combination thereof, which is added to the bath as fuel. In the reducing period the acidic oxide components are generated when aluminum or silicon is added to the bath to reduce other oxides from the slag.

The basic components, namely CaO and MgO, are conventionally added to the bath in the form of lime, magnesite or dolomite according to fixed ratios to the estimated $Al_2O_3$ and $SiO_2$ contents of the slag present. These additions may be divided into portions, some or all of which may be added to the bath at the beginning of the refining process. For example, 3.8 pounds of dolomite might be added for each pound of silicon contained in the transfer metal or to be used as fuel or reductant. At present, this is the only means available to an operator to determine the amounts of basic additions to be added for slag chemistry adjustment. Basic oxides may also be formed if compounds such as calcium carbide are added and oxidized.

In the conventional mode of operation, the acidic components supplied to the slag are largely based upon transfer metal's silicon content and the bath's thermal and reductant requirements, independent of the transfer metal and slag chemistry considerations. Concurrently with or upon completion of the reduction period, it is common practice as part of the final trim adjustment to add silicon to the melt in pure or alloy form to meet the melt specification for silicon independent of the slag chemistry at reduction. Accordingly, the final slag chemistry will generally fluctuate from one melt to another.

Uncontrolled fluctuations of slag chemistry have the following deleterious effects on the refining process, the product and the vessel:

1. The slag chemistry has a major influence on a slag's ability to remove sulfur from the metal. Inconsistent slag chemistries thus reduce the predictability of attaining a given final sulfur content in the metal. This results in either less consistent attainment of specified sulfur contents or in the use of slags which are overly powerful in their desulfurizing ability and consequently unnecessarily costly or burdensome to the process;

2. The wear rate of the vessel refractory lining, particularly of magnesite-chromite refractories, is sensitive to the slag chemistry such that changes in the $Al_2O_3$ to $SiO_2$ ratio in the slag affect the rate of chemical corrosion of the refractory and, thereby, the overall processing cost. Only by the control of the balance of all slag components can the refractory costs be optimized;

3. Inasmuch as the refractory wear rate is unpredictable, the chemistry of the steel produced also varies unpredictably. When magnesite-chromite refractories dissolve they contribute iron oxide and chromium oxide to the slag. These oxides resulting from refractory wear then react with the bath in the reducing period to form metallic iron and chromium in the metal phase while oxidizing silicon from the metal phase. Thus, to the extent that refractory wear is unpredictable the silicon loss from and iron and chromium pick-up by the metal is also unpredictable; and 4. The viscosity of the slag is a function of its chemistry and temperature. Therefore, uncontrolled variations in the slag chemistry affect the ease of slag handling, the efficiency of refining via slag-metal mixing and the extent to which alloy recoveries reach predictable equilibrium levels.

SUMMARY OF THE INVENTION

In accordance with the present invention the slag composition of the bath upon completion of the refining process will equal a preselected composition consisting essentially of A% alumina ($Al_2O_3$), B% silica ($SiO_2$), C% CaO and D% MgO with a ratio X of alumina to silica equal to a preselected value within a range of between about 0.1 to 10.0. The preselected slag chemistry at the completion of refining is achieved by using a combination of aluminum and silicon to achieve as completely as possible the preselected ratio of alumina to silica in the slag while at the same time satisfying the fuel, reduction, and specification silicon requirements of the bath at the given intervals corresponding to the end of the oxidizing period, the reducing period and the final trim. The estimated additions may be calculated in advance and limited to the oxidizing period and/or the reducing period and/or the final trim operation, with optimum results achieved by calculating an aluminum and silicon addition for each period to attain the preselected alumina to silica ratio at the end of the oxidizing period and at the end of the reducing period and at the end of the trim period so that the melt at the completion of the refining process will attain the preselected slag composition.

It should be understood that under certain extreme situations, the combination of the initial slag and metal chemistries, the fuel, reduction, and the specification silicon requirements and the particular slag chemistry preselected may make it impossible to fully attain the desired preselected slag chemistry, regardless of the combination of aluminum and silicon chosen for fueling, reduction and specification silicon. For example, if the metal transferred into the refining vessel contained a very high amount of silicon and the bath required little additional fuel or reduction additions and the preselected ratio of alumina to silica were very high, then even a practice of using only aluminum for fuel, reduction and indirect addition for specification silicon could fail to attain the desired preselected slag chemistry. In such extreme and unusual cases, use of the present invention would dictate a practice giving a slag chemistry most nearly conforming to the preselected chemistry of all conceivable combinations of alumina and silicon usage. By the same token, it is also possible, and in fact more likely, that the preselected slag chemistry may not be fully attained by the use of the less preferred embodiments of the present invention particularly when the invention is applied only to the fuel and/or reduction periods alone. Accordingly, for purposes of the present invention, "to attain the preselected slag chemistry" means to conform as effectively as possible the slag chemistry to the desired preselected slag chemistry without incurring the cost associated with a so called two slag process. By "two slag process" is meant the replacement of the slag in the refining vessel by totally or partially removing slag from the vessel and subsequently adding other slagmaking materials.

Broadly, the preferred embodiment of the present invention provides for controlling the slag composition of a metal bath in a refractory lined converter vessel during the process of refining the bath by the injection of oxygen gas during a period of oxidation and by the injection of nonoxidizing gas or gases during a period of reduction, so that the slag at the completion of the refining process will have a preselected composition consisting essentially of A% alumina ($Al_2O_3$) B% silica ($SiO_2$), C% CaO and D% MgO and a ratio "X" of alumina to silica equal to a preselected value, comprising the steps of:

(1) calculating the amounts of aluminum and silicon to be added to the melt as fuel in a combined proportion of from 0% to 100% aluminum and remainder silicon to produce a desired temperature rise in the bath upon completion of the period of oxidation and in a relative proportion to attain the desired ratio X of alumina to silica at the completion of the period of oxidation, taking into account the composition of the slag and metal at the outset of the oxidizing period;

(2) adding the fuel components of aluminum and silicon as calculated in step (1) to the bath at any time during the oxidizing period and oxidizing said fuel components;

(3) calculating the weights of alumina and silica present in the slag at the completion of step (2);

(4) calculating the amounts of aluminum and silicon to be added to the melt as reductants in a combined proportion of from 0% to 100% aluminum and remainder silicon to cause a substantially complete reduction of the bath and in a relative proportion to attain the desired ratio X of alumina to silica at the completion of the reducing period, taking into account the composition of the slag at the completion of step (2);

(5) adding the calculated amount of reductant set forth in step (4) to the bath at any time after the completion of decarburization;

(6) calculating the anticipated weights of alumina and silica present in the slag at the completion of reduction of the bath;

(7) calculating the amount of specification silicon to be added to meet the desired melt specification at the completion of the refining process;

(8) if the anticipated ratio of alumina to silica is equal to the preselected value X at the completion of reduction, then adding the amount of silicon calculated in step (7) to the melt simultaneous with or subsequent to step (5);

(9) if the ratio of alumina to silica calculated in step (6) is less than the preselected value X, then calculating the proportion of aluminum from 0 to 100% and remainder silicon needed to both meet the silicon specification and attain the preselected ratio of X in accordance with the following reaction:

$$4Al + 3SiO_2 \rightarrow 2Al_2O_3 + 3Si$$

(10) adding the aluminum and silicon calculated in step (9) simultaneous with or subsequent to step (5);

(11) calculating the anticipated weights of alumina and silica present in the slag after the use of steps (8) or (10);

(12) calculating the amounts of CaO and MgO to be added to the slag to attain the preselected slag chemistry based upon the calculated weights of alumina and silica present after step (11) and any amounts of these constituents already present in the slag; and

(13) adding the CaO and MgO calculated in step (12) to the melt at any time throughout the refining process.

Often, part of the anticipated CaO and/or MgO requirements for a given heat are precharged into the refining vessel before the metal is transferred into the vessel. In such cases, the total requirements of these constituents as calculated in the present invention are decremented by the amounts already precharged to calculate the subsequent additions of CaO and MgO.

OBJECTS

It is the principal object of the present invention to provide a method for controlling the slag chemistry of a bath in a refractory lined converter vessel.

It is a further object of the present invention to provide a method for controlling the slag composition of a bath in a refining vessel which utilizes the injection of oxygen gas, preferably subsurfacely, such that the slag at the completion of the refining process will have a preselected composition.

Other objects and advantages of the present invention will become apparent from the following detailed description of the invention.

DETAILED DESCRIPTION OF THE INVENTION

A comparison between the conventional practice for refining a liquid metal in a refining vessel by the subsurface injection of an oxygen gas and the practice of the present invention is illustrated in the following tables I and II:

specified to equal 0.40% at the end of refining. Also, in all cases it is desired to raise the bath temperature by 400° F., and it is considered that for the purpose of fuel estimation 6,500 pounds of refractory and essentially no slag participate in the thermal reactions. In both tables 1 and 2 the amount of transferred silicon is considered part of the total fuel requirement.

The conventional practice of Table I illustrates the typical lack of control over the slag chemistry experienced in oxygen injection refining of the bath, particularly for the refining of carbon and low alloy grades of steel. In each of the cases A–D in Table I, the formula for calculating the amounts of CaO and MgO to add to the slag is based upon an accepted practice of adding 3.8 pounds of dolomitic lime per pound of silicon in the transfer metal, fuel or reductant and 2.2 pounds of dolomitic lime per pound of aluminum added as fuel or reductant. The dolomitic lime is composed of 60% CaO and 40% MgO. In all four cases A–D the same degree of temperature rise is needed to satisfy the thermal needs of the bath, and aluminum is used to satisfy the added fuel requirements as a supplement to the initial silicon content. In cases B and D the higher transfer silicon levels provide greater fuel value and thus require less aluminum fuel than in cases A and C. Cases A and B are of a practice in which silicon is used for reduction. The unplanned variation of transfer silicon content in cases A and B causes the slag's alumina content to vary by 16%, the silica by 13%, the CaO by 2% and the MgO by 1%. Similar variations in slag chemistry are shown to result in cases C and D in which reduction is accomplished with additions of aluminum instead of silicon.

TABLE 1

| | | Conventional Practice | | | | | | |
|---|---|---|---|---|---|---|---|---|
| | | PRACTICE | | | RESULTANT SLAG CHEMISTRY | | | |
| | Transfer % Si | Fuel-lbs | Reduction lbs | Si Specification-lbs | % $Al_2O_3$ | % $SiO_2$ | % CaO | % MgO |
| A. | 0.1 | 24 Al | 13 Si | 40 Si | 35 | 9 | 34 | 23 |
| B. | 0.4 | 76 Si | 13 Si | 40 Si | 19 | 22 | 36 | 24 |
| C. | 0.1 | 24 Al | 16 Al | 40 Si | 41 | 33 | 33 | 22 |
| D. | 0.4 | 46 Si<br>90 Al<br>10 Si<br>70 Al | 16 Al | 40 Si | 26 | 16 | 35 | 23 |

TABLE 2

| | | Slag Control Practice | | | | | | |
|---|---|---|---|---|---|---|---|---|
| | | Preselected Slag Chemistry | | | | Resultant Practice | | |
| | Transfer % Si | % $Al_2O_3$ | % $SiO_2$ | % CaO | % MgO | Fuel-Lbs | Reduction-lbs | Si Specification-lbs |
| A. | 0.1 | 9 | 36 | 40 | 15 | 17 Al<br>83 Si | 3 Al<br>10 Si | 40 Si |
| B. | 0.4 | 9 | 36 | 40 | 15 | 17 Al<br>53 Si | 3 Al<br>10 Si | 40 Si |
| C. | 0.1 | 28 | 7 | 40 | 25 | 98 Al<br>2 Si | 13 Al<br>3 Si | 40 Si |
| D. | 0.4 | 28 | 7 | 40 | 25 | 70 Al | 16 Al | 21 Al<br>24 Si |

In the examples given in both tables I and II, the transfer metal composition is substantially identical other than for the transfer silicon content which varies to the same extent between the cases A–B and C–D in the two sets of examples. In all cases, 10,000 pounds of metal are being refined, and the melts are initially free of $Al_2O_3$, $SiO_2$, CaO and MgO. Other oxides present as iron oxide, manganese oxide or chromium oxide, which must be reduced to metallic form in the reduction step, contain 15 pounds of oxygen. The silicon content is In contrast, in Table II which illustrates the present invention the slag chemistry is preselected and the fuel, reductant and specification silicon additions are established to attain the preselected slag chemistry while satisfying the reduction, thermal and specification silicon needs of the melt. The methods for estimating the total thermal and reduction needs for the process, that is, the degrees Fahrenheit required and the heat capacity of the system and the amount of oxygen to be reduced are well known to those skilled in the art and are outside the scope of the present invention. However, practice of the present invention does not depend on an accurate estimation of the thermal needs of the bath. If the thermal needs are estimated incorrectly, but the method of the present invention is properly carried out, the resultant slag will still conform to the preselected aim chemistry, and the resultant silicon content will meet the silicon specification, but the bath at reduction will be at an undesirable temperature for tapping the melt. Corrective measures would have to be taken to adjust the bath temperature either in accordance with the present invention or otherwise.

Cases A and B in Table II illustrate how the present invention enables the attainment of a slag of relatively low desulphurizing capacity and low corrosiveness to magnesite-chromite refractories regardless of unplanned variations in the transfer silicon content. Cases C and D illustrate how a relatively highly desulphurizing slag also of low corrosiveness to magnesite-chromite refractories is attained inspite of the same transfer silicon variations. In case D, the silicon specification during the final trim adjustment is met by the addition of silicon and aluminum.

In the method of the present invention a combination of from 0 to 100% aluminum and the remainder silicon is used for both the fueling and reducing of the bath to attain a preselected slag chemistry of A% $Al_2O_3$, B% $SiO_2$, C% CaO and D% MgO with a specified ratio of alumina to silica in the range of between 0.1 to 10.0. The selection of the optimum percentage of each of the slag components for the preselected slag composition at the end of the refining process is outside the scope of the present invention.

The final slag chemistry consists essentially of the components $Al_2O_3$, $SiO_2$, CaO and MgO with all other constituents being of minor significance. Accordingly it will be assumed for purposes of illustrating the present invention that the above four components equal 100% of the slag. These four components can, of course, be assumed to have a total value of less than 100% without departing from the practice of the present invention.

Although for the purpose of the present description of the invention the fueling step of refining occurs first followed by the reduction step and finally by the trimming step, these events may occur in other chronologies, as when any of these three steps is performed more than once in the course of refining a given heat of metal. For example, a heat could be fueled and then reduced and late fueled and reduced again before the final trim. Variations in the chronology of these three steps do not limit the application of the present invention, but the description will be limited to the preferred chronological application of the invention. Accordingly, the first step of the process is carried out during the oxidizing period and consists of calculating the amounts of aluminum and silicon required as fuel to produce a desired temperature rise in the bath upon completion of the period of oxidation and in a relative proportion to attain the ratio X of alumina to silica at the completion of the period of oxidation taking into account the composition of the metal and slag at the onset of the oxidizing period. For purposes of the present disclosure, it is to be understood that by following this step the alumina to silica ratio at the completion of the oxidation period should approach the preselected chemistry byt may not necessarily reach it exactly. This is also true for the reducing period, and the method of the invention takes into account the possibility of a final trim adjustment which is to be carried out in a predetermined manner to complete the attainment of the desired alumina to silica ratio. It should be noted, however, that the method of the present invention permits the use of conventional practice for calculating the fuel additions during the oxidizing period, thereby limiting control of the slag chemistry to the reducing period and to the final trim adjustment. In this modified practice of the invention the fuel addition would be calculated as the amount of a fixed proportion of from 0 to 100% aluminum and remainder silicon to meet the thermal requirement of the melt and then adjust the slag chemistry by calculated combinations of additions of aluminum and silicon for the reduction and specification silicon additions as will be described later in the description. The proportion of aluminum and silicon used as fuels in such a modified practice of the invention would be the same from melt to melt regardless of the melt's transfer silicon content or fueling needs and would be such that the slag formed at the end of the fuel step could subsequently be adjusted to the aim chemistry.

For objectives external to the scope of the present invention, different values, X, of the desired ratio of alumina to silica may be chosen for each of the three described steps of processing. For example, in a practice wherein the fuel is added and oxidized before decarburization is performed, a lower ratio of alumina to silica may be chosen for the fuel step to avoid slopping, and a higher ratio of alumina to silica may be chosen for subsequent processing to provide greater desulphurization.

Likewise, conventional practice may be applied as well to the reducing period limiting the method of the present invention to the final trim adjustment alone or in combination with the oxidizing period. Stated otherwise, the method of the present invention need only apply to the final trim adjustment alone or to the oxidizing period or the reducing period or to any combination or permutation thereof. It is, however, preferred that control of the slag chemistry be undertaken during the oxidizing period and the reducing period in addition to the final trim adjustment.

The following describes the preferred practice of the invention using English units of measure for illustrative purposes:

1.1 The aim chemistry is A% $Al_2O_3$, B% $SiO_2$, C% CaO and D% MgO where A+B+C+D=100% and where A/B=X=a value from 0.1 to 10.0

1.2 Calculate the weights of aluminum fuel and silicon fuel needed to meet the thermal requirements of the melt during the oxidation period and attain the ratio X of $Al_2O_3$ to $SiO_2$ as follows:

(a) The desired pounds of alumina that should be produced by fueling the melt is given by the lesser of the following two formulas:

$$AF = \frac{X \cdot \left( \frac{H}{K_1} + SP_1 \right) - AP_1}{1 + \frac{K_2}{K_1} \cdot X} \quad \text{(i)}$$

$$AF = \frac{H}{K_2} \quad \text{(ii)}$$

where AF is the weight in pounds of alumina produced by the aluminum fuel addition;

$SP_1$ is the weight of $SiO_2$ present in the slag in the oxidation period before fueling. This is equal to the weight of the silicon introduced to the refining vessel in the transferred metal plus the weight of the silicon introduced from added alloys times 60/28 plus the weight of silica introduced to the vessel via any slag transferred into the vessel;

$AP_1$ is the weight of $Al_2O_3$ present in the slag in the oxidation period before fueling. This is equal to the weight of the aluminum introduced to the vessel either as a part of the charge metal or an addition times 102/54 plus the weight of any alumina charged into the vessel via the transfer slag;

H equals the temperature rise required in degrees Fahrenheit times the effective weight in tons of the system of metal, slag and refractories participating in the thermal balance. The calculation of the temperature requirement takes into account the degrees Fahrenheit the melt must be heated from the beginning to the end of refining in the vessel to reach the aim tap temperature, the heat losses in degrees Fahrenheit anticipated during that time interval and the cooling effect on the melt in degrees Fahrenheit from all the additions made in the vessel whether they be alloy or flux additions;

$K_1$ is the heat provided in degrees Fahrenheit per pound of silica generated for one ton of the system participating in the thermal balance produced in the following reaction:

$$Si(\text{solid, } 70^\circ \text{ F.}) = O_2(\text{gas, } 70^\circ \text{ F.}) = SiO_2 \text{ (slag, bath temperature)}$$

$K_2$ is the heat provided in degrees Fahrenheit per pound of alumina generated for one ton of the system participating in the thermal balance produced by the following reaction:

$$2Al(\text{solid, } 70^\circ \text{ F.}) + 3/2O_2(\text{gas, } 70^\circ \text{ F.}) = Al_2O_3(\text{slag, bath temperature})$$

$K_1$ and $K_2$ are constants with the preferred values of 14 and 15.9 respectively.

(b) Once AF is calculated, the pounds of aluminum fuel to be added is equal to AF times 54/102 minus the pounds of aluminum already present in the metal;

(c) The amount of silica in pounds that should be produced by fueling the melt is given by the formula:

$$SF = \frac{H - K_2 \cdot AF}{K_1}$$

where SF is the weight in pounds of silica produced by the silicon fuel addition.

(d) Once SF is calculated, the pounds of silicon fuel to be added is equal to SF times 28/60 minus the pounds of silicon already present in the metal.

1.3 The calculated additions of aluminum and silicon are added to the melt as fuel components at any time during the oxidizing period to oxidize the fuel components.

2.0 The second step of the process involves calculating the amounts of alumina and silica to be generated by the reduction of the bath to substantially attain complete reduction and to attain the desired ratio X of alumina to silica in the slag after reduction, taking into account the composition of the slag at the completion of the oxidizing period. For purposes of the present disclosure, reduction is substantially complete when the oxides of Fe, Mn and Cr are substantially reduced to give the metallic form of these elements. This is preferably calculated as follows:

2.1 Calculate the pounds of alumina, $AP_2$, and silica, $SP_2$, present in the slag after the oxidizing period is completed based on the following:

$$AP_2 = AP_1 + AF$$

$$SP_2 = SP_1 + SF$$

2.2 Calculate the weight of aluminum and silicon needed to reduce the bath and attain an $Al_2O_3$ to $SiO_2$ ratio of X. The desired pounds of alumina that should be produced during reduction, AR, is given by the lesser of the two following formulas:

$$AR = \frac{X \cdot \left(\frac{R}{K_3} + SP_2\right) - AP_2}{1 + \frac{K_4}{K_3} \cdot X} \quad \text{(i)}$$

$$AR = \frac{R}{K_4} \quad \text{(ii)}$$

where R equals the pounds of oxygen in the slag that are to be reduced by the combination of aluminum and silicon. It is calculated by deducting the pounds of oxygen that the oxidize aluminum, silicon or carbon from the total pounds of oxygen added into the melt during processing.

$K_3$ is the pounds of oxygen reduced when one pound of silica is formed in the slag. The preferred value of $K_3$ is 32/60.

$K_4$ is the pounds of oxygen reduced when one pound of alumina is formed. The preferred value of $K_4$ is 48/102.

2.3 The pounds of aluminum to be used as a reductant, SR, is equal to AR×54/102.

2.4 The pounds of silica, SR, produced during reduction is given by the formula:

$$SR = \frac{R - K_4 \cdot AR}{K_3}$$

2.5 The pounds of silicon to be used as a reductant is equal to SR times 28/60.

2.6 Add the calculated amounts of aluminum and silicon for use as reductants to establish substantially complete reduction of the melt at any time after decarburization.

3.0 The third step of the process involves calculating the amount of alumina to be generated and silica to be reduced from the slag by the form of the specification silica addition to provide the specified silicon content in the metal and attain the desired ratio X of alumina to silica in the slag after the addition of specification silicon, taking into account the amounts of those oxides present in the slag before the specification silicon addition. This step is the final trim adjustment, which in accordance with the present invention requires two separate considerations. If the ratio of alumina to silica is equal to the desired ratio X before the specification silicon is added, then the specification silicon can be met solely by the addition of silicon to the melt. If however, the ratio of alumina to silica is less than the preselected value X, then the specified silicon content at completion of the process would not be satisfied by the addition of silicon to the melt as in conventional practice, but by a combination of silicon and aluminum. When mixed with the silica bearing slag the aluminum addition will react according to the following reactions:

$$4Al(\%, metal)+3SiO_2(slag)\rightarrow 3Si(\%, metal)+2Al_2O_3(slag).$$

The above reaction causes the aluminum added to form $Al_2O_3$ in the slag while providing the specified silicon content for the metal and lowering the $SiO_2$ content of the slag with the net effect being an increase in the ratio of alumina to silica.

The preferred method of calculating the amount of specification silicon to be added directly as silicon and indirectly as aluminum is as follows:

3.1 Calculating $AP_3$ and $SP_3$, the pounds of alumina and silica present in the slag, respectively, after the reduction step as follows:

$$AP_3=AP_2+AR$$

$$SP_3=SP_2+SR;$$

3.2 calculating the pounds of alumina to be generated in the slag to provide specification silicon to the metal by selecting the lesser of the following two formulas:

$$AS=\frac{X\cdot SP_3-AP_3}{1+\frac{K_6}{K_5}\cdot X} \quad \text{(i)}$$

$$AS=\frac{S}{K_6}$$

where AS is the weight in pounds of alumina in the slag as a result of the addition of aluminum to indirectly provide specification silicon;

S is the total pounds of silicon needed to meet the specification silicon content in the metal which is calculated in accordance with conventional practice;

$K_5$ is the pounds of silicon produced in the metal by the reduction of one pound of silica from the slag. $K_5$ is preferably equal to 28/60;

$K_6$ is the pounds of silicon produced in the metal per pound of alumina produced from the indirect silicon addition:

$$4Al+3SiO_2\rightarrow 2Al_2O_3+3Si$$

$K_6$ is preferably equal to 7/17.

3.3 The pounds of aluminum to be used in an indirect addition for specification silicon is equal to AS time 54/102.

3.4 The pounds of silica, SS, produced by the specification silicon addition is given by the following formula:

$$SS=(-K_6/K_5)\cdot AS$$

(Note that SS is a negative quantity indicating that silica is being reduced.)

3.5 The pounds of silicon to be used as a direct addition for specification silicon is given by the following formula.

$$PS=\text{Pounds of Silicon to be Added}=S+(28/60)\cdot SS$$

(Note that since SS is a negative number the pounds of silicon to be added "PS" is less than "S" the total pounds needed.)

3.6 Add the combination of aluminum and silicon to the melt to generate alumina and reduce silica as calculated in 3.3 and 3.5 at any time after decarburization has been completed.

3.7 Calculate the total pounds of alumina, $AP_4$, and silica, $SP_4$, in the slag upon completion of step 3.6 of the process as follows:

$$AP_4=AP_3+AS$$

$$SP_4=SP_3+SS$$

4.0 Calculate the amounts of CaO and MgO to be added to the slag to attain the preselected slag composition of A% alumina, B% silica, C% CaO and D% MgO based upon the calculated weights of alumina and silica following the silicon specification adjustment. The preferred calculation for the pounds of CaO and MgO to be added to the slag to attain the desired slag chemistry is as follows:

$$\text{Pounds CaO}=\frac{C}{A+B}\times(AP_4+SP_4)-CP$$

$$\text{Pounds MgO}=\frac{D}{A+B}\times(AP_4+SP_4)-MP$$

Where A, B, C and D are the preselected percentages and CP and MP are the pounds of CaO and MgO, respectively, already present in the slag. The computation of the weights of lime, dolomite and magnesite to be added to provide the required quantities of CaO and MgO in the slag is conventional and outside the scope of the present invention.

4.1 The calculated pounds of CaO and MgO in step 4 may be added to the melt at any time in the refining process and may also include multiple additions.

It should be understood by those skilled in the art that the above steps 1–4 of the method may be calculated in advance of a refining operation for a known transfer melt and that the calculations may be performed using the aid of a computer. An operator need only add to the melt the precalculated additions of aluminum and silicon at the appropriate times as set forth in steps 1–4 of the process.

The principles of forming a slag of a preselected chemistry while at the same time satisfying the thermal, reduction and specification silicon addition requirements of the melt are used in three distinct steps of fueling, reduction and specification silicon addition, where aluminum and silicon additions are interchangeably made to the melt resulting in calculated combinations of alumina and/or silica being generated in or reduced from the slag. Each of the three of these steps for combining aluminum and silicon as additives are novel parts of the invention. The preferred embodiment of the present invention is to add the aluminum and silicon in calculated combinations in each of the three steps. The benefits of the invention could entirely or substantially be gained, however, by employing one or two of the three steps to make calculated additions of aluminum and silicon, while using conventional or other methods not included in the present invention to calculate the combination of aluminum and silicon in the remaining steps of their addition.

For example, to attain a slag of preselected chemistry it would be possible to add a fixed ratio of aluminum and silicon as fuel, regardless of the initial slag and metal chemistries or of the total fuel requirement, to meet the fuel requirement but not necessarily attain the preselected slag chemistry or desired ratio of alumina to silica. The resultant slag at the end of fueling could then be adjusted to attain the preselected slag chemistry during subsequent refining by using the methods described in the present invention for calculating the combination of aluminum and silicon added in the reduction and specification silicon additions.

Similarly, the reduction requirements of a given melt could be calculated in advance and met by a fixed ratio combination of aluminum and silicon, the value of the fixed ratio not being calculated by the present invention. The fuel and specification silicon combinations of aluminum and silicon could then be made to adjust the slag to a preselected chemistry in accordance with the present invention, anticipating the chemical effects of the reduction additions on the slag chemistry. It is anticipated that in most cases of starting conditions, preselected slag chemistries, and reduction and thermal requirements, that the application of the present invention to the fuel and reduction periods will permit the conventional addition of silicon to provide the specification silicon without the use of indirect aluminum additions. It is further possible that in certain cases the use of only one step of the present invention for calculating the combination of aluminum and silicon to add for the addition of fuel, reduction or specification silicon would be sufficient to adjust the slag to a preselected slag chemistry and to accommodate the anticipated use of methods not included in the present invention for the combination of aluminum and silicon used in the other two of the three steps.

As an illustration, a given heat of 10 tons of metal is transferred into a converter vessel with 100 pounds of slag composed of 30% $SiO_2$, 10% $Al_2O_3$, 50% CaO, and 10% MgO and with 10 pounds of silicon contained in the metal. In this practice the reduction is accomplished by equal amounts of aluminum and silicon. In the given heat it is anticipated that 10 pounds of oxygen must be reduced from the bath such that an addition of 5 pounds of aluminum and 5 pounds of silicon will be added to accomplish the reduction. In this practice the specification silicon is always added in the form of a ferrosilicon alloy, which does not affect the slag chemistry. In this illustration, it can be anticipated, using stoichiometric relationships, that the slag will contain 63 pounds of $SiO_2$ (30 pounds from the transfer slag, 21 pounds from the oxidation of the transfer silicon, and 11 pounds from the reduction silicon addition), 19 pounds of $Al_2O_3$ (10 pounds from the transfer slag and 9 pounds from the reduction Al addition), 50 pounds of CaO and 10 pounds of MgO (both from the transfer slag) apart from the effects of the fuel step. In the given heat, 10 tons of metal, 0.05 tons of slag, and an estimated 3.95 tons of refractory must be heated 200° F. by fuel and a preselected slag chemistry of 24% $Al_2O_3$, 16% $SiO_2$, 40% CaO, and 20% MgO is desired, giving a desired ratio of $Al_2O_3$ to $SiO_2$ equal to 1.5. Using the present invention the combinations of aluminum and silicon to be added as fuel can be calculated to both meet the thermal needs and attain the preselected slag chemistry. According to the present description the total thermal need, H, is equal to 200° F. times 14 tons or 2800. Using the anticipated pounds of alumina and silica generated from the transfer metal and slag and the reduction reactions as the values of $AP_1$ and $SP_1$, the correct fuel addition is 74 pounds of aluminum and 20 pounds of silicon, generating 139 pounds of alumina and 42 pounds of silica in the slag. The total alumina and silica contents of the slag as a result of all processing are then 158 pounds and 105 pounds, respectively, thus attaining the desired ratio of alumina to silica of 1.5. The CaO and MgO additions are 213 pounds CaO and 111 pounds MgO, giving 657 pounds of slag of the preselected chemistry.

What is claimed is:

1. A process for controlling the slag composition of a metal bath in a refractory lined vessel during the process of refining the bath by the injection of oxygen gas during a period of oxidation and by the injection of nonoxidizing gas or gases during a period of reduction and melt specification adjustment such that the slag at the completion of the refining process will have a composition consisting essentially of A% alumina ($Al_2O3$), B% silica ($SiO_2$), C% CaO and D% MgO and a ratio of alumina to silica equal to a value A/B, said process comprising the steps of:

(1) adding aluminum and silicon to the bath as fuel components in a combined proportion of from 0 to 100% Al remainder Si to cause the bath to rise in temperature to a predetermined level upon completion of the period of oxidation and to provide a ratio of alumina to silica which is substantially equal to the value A/B;

(2) establishing the weight of alumina and silica present in the slag at the completion of step 1 from the stoichiometric relationships between aluminum and alumina and between silicon and silica respectively and from the weights of aluminum, alumina, silicon and silica present before the addition;

(3) adding aluminum and silicon to the bath as reductants in a combined proportion of from 0% to 100% aluminum and remainder silicon to cause a substantially complete reduction of the melt and to provide a ratio of alumina to silica which is substantially equal to the ratio A/B;

(4) establishing the weight of alumina and silica present in the slag at the completion of reduction of the bath from the stoichiometric relationships between aluminum and alumina and between silicon and silica respectively and from the weights of alumina and silica established in step (2);

(5) establishing the amount of specification silicon to be added to meet the desired melt specification at the completion of the refining process by multiplying the weight of the metal in the bath by the desired percentage of silicon in the bath at the completion of the refining process;

(6) if the ratio of alumina to silica is equal to the value A/B at the completion of reduction, then adding the amount of silicon established in step (5) to the metal;

(7) if the ratio of alumina to silica from the weights established in step (4) is less than the value A/B at the completion of reduction, then calculating the proportion of aluminum from 0 to 100% and remainder silicon needed to both meet the silicon specification and attain the ratio of A/B in accordance with the following reaction:

$$4Al+3SiO_2 \rightarrow 2Al_2O_3+3Si$$

(8) adding the aluminum and silicon as required in accordance with step (7) simultaneous with or subsequent to step (3);

(9) establishing the weights of alumina and silica present in the slag at the completion of step (6) or (8) from their stoichiometric relationships with aluminum and silicon; and

(10) adding CaO and MgO to the bath such that the following equations are satisfied:

$$\mathrm{CaO} = \frac{C}{A+B} \times (AP_4 + SP_4) - CP$$

$$\mathrm{MgO} = \frac{D}{A+B} D \times (AP_4 + SP_4) - MP$$

where $AP_4$ is the weight of alumina from step (9), $SP_4$ is the weight of silica from step (9), CP and MP are the weights of CaO and MgO respectively, already in the slag, CaO and MgO are the respective weights of CaO and MgO added in this step and A, B, C and D are the preselected percentages.

2. A process as defined in claim 1 wherein the metal is selected from the group comprising carbon steels, low alloy steels, stainless steels, tool steels and nickel and cobalt based alloys.

3. A process as defined in claim 2 wherein the ratio A/B of alumina to silica is selected from a range of between 0.1 to 10.0.

4. A process as defined in claim 3 wherein the amount of aluminum and silicon added in step (1) is established from the selection of the weight of alumina and silica generated by the addition and oxidation of aluminum fuel and silicon fuel with the alumina calculated in accordance with the lesser value of the following two formulas:

$$AF = \frac{X \cdot \left(\frac{H}{K_1} + SP_1\right) - AP_1}{1 + \frac{K_2}{K_1} \cdot X} \quad \text{(i)}$$

$$AF = \frac{H}{K_2} \quad \text{(ii)}$$

where:

AF is the weight of alumina produced by the aluminum fuel addition:

$AP_1$ is the weight of alumina present in the slag at the outset of the fueling operation;

$SP_1$ is the weight of silica present in the slag at the outset of the fueling operation;

H is equal to the temperature rise multiplied by the effective weight of the melt and refractories participating in the thermal balance;

$K_1$ is a calculated constant representing the heat provided in degrees per pound of silica produced for a unit weight of the participants in the thermal balance in accordance with the following reaction:

Si (solid, 70° F.)+$O_2$ (gas, 70° F.)=$SiO_2$ (slag, bath temperature)

$K_2$ is a calculated constant representing the heat in degrees per unit weight of alumina for a unit weight of the participants in the thermal balance produced in accordance with the following reaction:

2Al (solid, 70° F.)+$3O_2$ (gas, 70° F.)=$Al_2O_3$ (slag, bath temperature); and X=ratio of A/B calculating the aluminum fuel requirement from the stoichiometric conversion of the value for AF;

similarly calculating the desired weight of silica that is generated by the addition of silicon fuel in accordance with the following equation:

$$SF = \frac{H - K_2 \cdot AF}{K_1}$$

where SF is the weight of silica produced by the silicon fuel; and calculating the silicon fuel requirement from the stoichiometric conversion of the value of SF.

5. A process as defined in claim 4 wherein for H being the product of the required bath temperature rise in degrees Fahrenheit times the thermal system's mass in tons, and all other weights being measured in pounds, $K_1$ is 14.0 and $K_2$ is 15.9.

6. A process as defined in claim 4 wherein the aluminum and silicon added as reductants in step (3) is determined from the respective weights of alumina and silica in accordance with the following equations:

$$AR = \frac{X \cdot \left(\frac{R}{K_3} + SP_2\right) - AP_2}{1 + \frac{K_4}{K_3} X} \quad \text{(a)}$$

$$AR = \frac{R}{K_4} \quad \text{(b)}$$

$$SR = \frac{R - K_4 \cdot AR}{K_3} \quad \text{(c)}$$

where:

AR is the weight of alumina produced during reduction, and is taken as the lesser of (a) and (b);

$AP_2$ is the weight of alumina in the slag at the outset of the reducing period;

$SP_2$ is the weight of silica in the slag at the outset of the reducing period;

R is the weight of oxygen in the melt at the outset of the reducting period that is to be reduced by the additions of aluminum and/or silicon;

$K_3$ is the weight of oxygen reduced when one unit of weight of silica is formed in the slag:

$K_4$ is the weight of oxygen reduced when one unit of weight of alumina is formed;

SR is the weight of silica produced during reduction;

calculating the weight of aluminum and silicon to be used as a reductants from AR and SR, respectively, using stoichiometric relationships.

7. A process as defined in claim 6 with all weights measured in the same units, wherein $K_3$ is 0.533 and $K_4$ is 0.47.

8. A process as defined in claim 7 wherein the weight of alumina to be generated in the slag to provide specification silicon is determined from the lesser of the following two formulas:

$$AS = \frac{X \cdot SP_3 - AP_3}{1 + \frac{K_6}{K_5} \cdot X} \quad \text{(i)}$$

-continued $$AS = \frac{S}{K_6}$$

where

AS is the weight of alumina in the slag as a result of the addition of aluminum for providing specification silicon;

$AP_3$ and $SP_3$ are the weights of alumina and silica, respectively, which are present in the slag before the addition of specification silicon and are separately calculated as follows:

$$AP_3 = AP_2 + AR$$

$$SP_3 = SP_2 + SR$$

S is the total weight of silicon needed to meet the specification silicon content in the melt;

$K_5$ is the weight of silicon produced in the metal by the reduction of one unit of weight of silica from the slag; and $K_6$ is the weight of silicon produced in the metal per unit weight of alumina produced from the indirect silicon addition according to the formula:

$$4Al + 3SiO_2 \rightarrow 2Al_2O_3 + 3Si$$

the weight of aluminum to be used in the specification silicon addition is calculated from AS using the stoichiometric relationship of aluminum to alumina;

similarly the desired weight of silica, SS, that should be generated from the specification silicon addition is calculated in accordance with the following formula:

$$SS = (-K_6/K_5) \cdot AS$$

and the weight of silicon to be used for the specification silicon addition is calculated from SS and S using the stoichiometric relationship of silicon to silica.

9. A process as defined in claim 8 wherein for all weights measured in the same units, $K_5$ is equal to 0.46 and $K_6$ is equal to 0.41.

10. A process as defined in claims 3 or 9 wherein the oxygen gas and nonoxidizing gas are injected subsurfacely in accordance with the practice of AOD.

11. A process as defined in claim 10 wherein the refractory lining in the refractory vessel comprises magnesite-chromite.

12. A process for controlling the slag composition of a metal bath in a refractory lined vessel during the process of refining the melt by the injection of oxygen gas during a period of oxidation and by the injection of nonoxidizing gas or gases during a period of reduction and melt specification adjustment such that the slag at the completion of the refining process will have a composition consisting essentially of A% alumina ($Al_2O_3$), B% silica ($SiO_2$), C% CaO and D% MgO and a ratio of alumina to silica equal to A/B, said process comprising the steps of:

(1) calculating the amount of specification silicon to be added to meet the desired melt specification at the completion of the refining process by multiplying the weight of the metal in the bath by the desired percentage of silicon in the bath at the completion of the refining process;

(2) adding aluminum from 0 to 100% and remainder silicon needed to both meet the silicon specification of step (1) and attain the preselected ratio of X in accordance with the following reaction:

$$4Al + 3SiO_2 \rightarrow 2Al_2O_3 + 3Si$$

(3) establishing the weights of alumina and silica in the slag after the completion of step (2) from their stoichiometric relationships with aluminum and silicon and from the weights of alumina and silica present in the slag prior to step (2); and (4) adding CaO and MgO to the bath such that the following equations are satisfied:

$$CaO = \frac{C}{A+B} \times (AP_4 + SP_4) - CP$$

$$MgO = \frac{D}{A+B} \times (AP_4 + SP_4) - MP$$

where $AP_4$ is the weight of alumina and $SP_4$ the weight of silica established in step (3) and CP and MP the weights of CaO and MgO already in the slag, CaO and MgO are the respective weights of CaO and MgO added in this step and A, B, C and are the preselection percentages.

13. A process as defined in claim 12 wherein the amount of alumina to be generated in the slag to provide specification silicon is determined from the lesser of the following two formulae:

$$AS = \frac{X \cdot SP_3 - AP_3}{1 + \frac{K_6}{K_5} \cdot X} \quad \text{(i)}$$

$$AS = \frac{S}{K_6}$$

where

AS is the weight of alumina in the slag as a result of the addition of aluminum;

$AP_3$ and $SP_3$ are the calculated weights of alumina and silica, respectively, which are present in the slag after the completion of reduction;

S is the total weight of silicon needed to meet the specification silicon content in the melt;

$K_5$ is the weight of silicon produced in the metal per unit weight of silicon reduced from the slag; X is the ratio of A/B; and $K_6$ is the weight of silicon produced in the metal per unit weight of alumina produced from the indirect silicon addition according to the reaction:

$$4Al + 3SiO_2 \rightarrow 2Al_2O_3 + 3Si$$

the weight of aluminum to be used in the specification silicon addition is calculated from AS using the stoichiometric relationship of aluminum to alumina;

similarly the desired weight of silica, SS, that should be generated from the specification silicon addition is calculated in accordance with the following formula:

$$SS = (-K_6/K_5) \cdot AS$$

and the weight of silicon to be used for the specification silicon addition is calculated from SS and S using the stoichiometric relationship of silicon to silica.

14. A process as defined in claim 13 wherein for all weights measured in the same units, $K_5$ is equal to 0.46 and $K_6$ is equal to 0.41.

15. A process as defined in claim 14 wherein the metal is selected from the group comprising carbon steels, low alloy steels, stainless steels, tool steels and nickel and cobalt based alloys.

16. A process as defined in claim 15 wherein the ratio X of alumina to silica is selected from a range of between about 0.1 to 10.0.

17. A process as defined in claim 16 wherein the oxygen gas and nonoxidizing gas are injected subsurfacely in accordance with the practice of AOD.

18. A process as defined in claim 17 wherein the refractory lining in the refractory vessel comprises magnesite-chromite.

19. A process for controlling the slag composition of a metal bath in a refractory lined vessel during the process of refining the bath by the injection of oxygen gas during a period of oxidation and by the injection of nonoxidizing gas or gases during a period of reduction and melt specification adjustment such that the slag at the completion of the refining process will have a composition consisting essentially of A% alumina ($Al_2O_3$), B% silica ($SiO_2$), C% CaO and D% MgO and a ratio of alumina to silica equal to a A/B, said process comprising the steps of:

(1) adding aluminum and silicon to the bath as fuel components in a combined proportion of from 0 to 100% Al remainder Si to cause the bath to rise in temperature to a predetermined level upon completion of the period of oxidation and to provide a ratio of alumina to silica which is substantially equal to the value A/B;

(2) establishing the weights of alumina and silica present in the slag at the completion of step (1) from the stoichiometric relationships between aluminum and alumina and between silicon and silica respectively and the weights of aluminum, alumina, silicon and silica present before step (1);

(3) adding aluminum and silicon to the bath as reductants at any time after the oxidation period is completed to substantially attain complete reduction of the bath;

(4) adding silicon to the bath either simultaneously with or subsequent to step (3) as needed to meet the desired melt specification at the completion of the refining process;

(5) establishing the weights of alumina and silica present in the slag at the end of the refining process from their stoichiometric relationships with aluminum and silicon and from the weight of alumina and silica present before step (3); and (6) adding CaO and MgO to the bath such that the following equations are satisfied:

$$\mathrm{CaO} = \frac{C}{A+B} \times (AP_4 + SP_4) - CP$$

$$\mathrm{MgO} = \frac{D}{A+B} \times (AP_4 + SP_4) - MP$$

where $AP_4$ is the weight of alumina from step (5), $SP_4$ is the weight of silica from step (5), CP and MP are the weights of CaO and MgO respectively, already in the slag, CaO and MgO are the respective weights of CaO and MgO added in this step and A, B, C and D are the preselected percentages.

20. A process as defined in claim 19 wherein the metal is selected from the group comprising carbon steels, low alloy steels, stainless steels, tool steels and nickel and cobalt based alloys.

21. A process as defined in claim 20 wherein the ratio of alumina to silica is selected from a range of between about 0.1 to 10.0.

22. A process as defined in claim 21 wherein the oxygen gas and nonoxidizing gas are injected subsurfacely in accordance with the practice of AOD.

23. A process as defined in claim 22 wherein the refractory lining in the refractory vessel comprises magnesite-chromite.

24. A process as defined in claim 23 wherein the weight of aluminum and silicon in step (1) are determined by calculating the desired weight of alumina that should be generated by the aluminum fuel in accordance with the lesser value of the following two formulae:

$$AF = \frac{X \cdot \left(\frac{H}{K_1} + SP_1\right) - AP_1}{1 + \frac{K_2}{K_1} \cdot X} \quad \text{(i)}$$

$$AF = \frac{H}{K_2} \quad \text{(ii)}$$

where:

AF is the weight of the alumina produced by the aluminum fuel addition in step (1);

$AP_1$ is the weight of alumina present in the slag at the outset of the fueling operation;

$SP_1$ is the weight of silica present in the slag at the outset of the fueling operation;

H is equal to the temperature rise mulitplied by the effective weight of the bath and refractories participating in the thermal balance;

$K_1$ is a calculated constant representing the heat provided in degrees per unit weight of silica produced for a unit weight of the participants in the thermal balance in accordance with the following reaction:

Si (solid, 70° F.)+$O_2$ (gas, 70° F.)=$SiO_2$ (slag, bath temperature)

$K_2$ is a calculated constant representing the heat in degrees per unit weight of alumina produced for a unit weight of the participants in the thermal balance in accordance with the following reaction:

2Al (solid, 70° F.)+3/2$O_2$ (gas, 70° F.)=$Al_2O_3$ (slag, bath temperature);

and X=ratio of A/B calculating the aluminum fuel requirement from the stoichiometric conversion of the value for AF;

calculating the desired weight of silica that should be produced by the addition of silicon fuel in accordance with the following equation:

$$SF = \frac{H - K_2 \cdot AF}{K_1}$$

where SF is the weight of silica produced by the silicon fuel; and calculating the silicon fuel requirement from the stoichiometric conversion of the value of SF.

25. A process as defined in claim 24 wherein for H being the product of the required bath temperature rise in degrees Fahrenheit times the thermal system's mass in tons and all other weights being in pounds, $K_1$ is 14.0 and $K_2$ is 15.9.

26. A process for controlling the slag composition of a metal bath in a refractory lines vessel during the process of refining the bath by the injection of oxygen gas during a period of oxidation and by the injection of nonoxidizing gas or gases during a period of reduction and melt specification adjustment such that the slag at the completion of the refining process will have a composition consisting essentially of A% alumina ($Al_2O_3$), B% silica ($SiO_2$). C% CaO and D% MgO and a ratio of alumina to silica equal to a A/B, said process comprising the steps of:

(1) adding aluminum and silicon to the melt as reductants in a combined proportion of from 0% to 100% aluminum and remainder silicon to cause a substantially complete reduction of the melt and in a relative proportion to provide a ratio of alumina to silica in the slag which is substantially equal to the value A/B;

(2) establishing the weights of alumina and silica present in the slag at the completion of reduction of the bath from the stoichiometric relationships between aluminum and alumina and between silicon and silica respectively and from the weights of aluminum, almumina, silicon and silica present before step (1);

(3) adding silicon to the bath simultaneous with or subsequent to step (1) as needed to meet the desired melt specification at the completion of the refining process; and (5) adding CaO and MgO to the bath such that the following equations are satisfied:

$$\text{CaO} = \frac{C}{A + B} \times (AP_4 + SP_4) - CP$$

$$\text{MgO} = \frac{D}{A + B} D \times (AP_4 + SP_4) - MP$$

where $AP_4$ is the weight of alumina from step (2), $SP_4$ is the weight of silica from step (2), CP and MP are the weights of CaO and MgO respectively, already in the slag, CaO and MgO are the respective weights of CaO and MgO added in this step and A, B, C and D are the preselected percentages.

27. A process as defined in claim 26 wherein the metal is selected from the group comprising carbon steels, low alloy steels, stainless steels, tool steels and nickel and cobalt based alloys.

28. A process as defined in claim 27 wherein the ratio of alumina to silica is selected from a range of between about 0.1 to 10.0.

29. A process as defined in claim 28 wherein the oxygen gas and nonoxidizing gas are injected subsurfacely in accordance with the practice of AOD.

30. A process as defined in claim 29 wherein the relative proportion of aluminum and silicon added as reductants in step (1) is determined by calculating the respective weights of alumina and silica generated during reduction in accordance with the following equations:

$$AR = \frac{X \cdot \left(\frac{R}{K_3} + SP_2\right) - AP_2}{1 + \frac{K_4}{K_3} X} \quad \text{(a)}$$

$$AR = \frac{R}{K_4} \quad \text{(b)}$$

$$SR = \frac{R - K_4 \cdot AR}{K_3} \quad \text{(c)}$$

where:

AR is the weight of alumina produced during reduction and is taken to be the lesser of (a) and (b);

$AP_2$ is the weight of alumina in the slag at the outset of the reducing period;

$SP_2$ is the weight of silica in the slag at the outset of the reducing period;

R is the weight of oxygen in the melt at the the weight of oxygen in the melt at the outset of the reducing period that is to be reduced by the additions of aluminum and silicon;

$K_3$ is the weight of oxygen reduced when one unit of weight of silica is formed in the slag;

$K_4$ is the weight of oxygen reduced when one unit of weight of alumina is formed;

SR is the weight of silica produced during reduction;

X is the ratio of A/B;

and calculating the weights of aluminum and silicon from the respective calculated weights of AR and SR using stoichiometric relationships.

31. A process as defined in claim 30 wherein for all weights measured in the same unit, $K_3$ is 32/60 and $K_4$ is 48/102.

32. A process as defined in claim 31 wherein the lining of the refractory vessel comprises magnesite-chromite.

* * * * *

UNITED STATES PATENT AND TRADEMARK OFFICE

CERTIFICATE OF CORRECTION

PATENT NO. : 4,551,175

DATED : November 5, 1985

INVENTOR(S) : Balkishan Agrawal

It is certified that error appears in the above-identified patent and that said Letters Patent is hereby corrected as shown below:

Column 1, line 33 - "as" should read "has"

Column 1, line 53 - "priod" should read "period"

Column 1, line 64 - "conveniently" should read "conventionally"

Column 5, Tables I and II - printed material under Fuel-Lbs columns are in error as per Amendment filed May 13, 1985. In Table I Fuel-lbs column should read:

| | |
|---|---|
| 100 Al | |
| 70 Al | |
| 100 Al | |
| 70 Al | |

In Table II Fuel-Lbs column should read:

| |
|---|
| 24 Al |
| 76 Si |
| 24 Al |
| 46 Si |
| 90 Al |
| 10 Si |
| 70 Al |

Column 7, line 51 - "late" should read "later"

Column 7, line 67 - "byt" should read "but"

Column 9, line 29 - "Si(solid,70°F.)=$O_2$" should read "Si(solid,70°F.)+$O_2$"

Column 11, line 4 - "reactions:" should read "reaction:"

UNITED STATES PATENT AND TRADEMARK OFFICE

CERTIFICATE OF CORRECTION

PATENT NO. : 4,551,175

DATED : November 5, 1985

INVENTOR(S) : Balkishan Agrawal

It is certified that error appears in the above-identified patent and that said Letters Patent is hereby corrected as shown below:

Column 11, line 33 - numerical designation for second formula is missing - should read "(ii)"

Column 16, line 47 - "reducting" should read "reducing"

Column 16, line 50 - "slag:" should read "slag;"

Column 17, line 1 - numerical designation for second formula is missing - should read "(ii)"

Column 18, line 27 - after "C and" should read "C and D"

Column 18, line 39 - numerical designation for second formula is missing - should read "(ii)"

Column 21, line 23 - "($SiO_2$)." should read "($SiO_2$);"

Column 22, lines 38-39 - delete "the weight of oxygen in the melt at the" second occurrence, typed twice in sentence Signed and Sealed this Eighth Day of September, 1987

*Attest:*

DONALD J. QUIGG

*Attesting Officer*

*Commissioner of Patents and Trademarks*